US005470074A

United States Patent [19]

Hotchkiss et al.

[11] Patent Number: 5,470,074

[45] Date of Patent: Nov. 28, 1995

[54] GOLF PRACTICE TEE APPARATUS HAVING SELECTIVELY ADJUSTABLE INCLINATION FOR SIMULATING UNEVEN LIES AND METHOD FOR USE OF SAME

[76] Inventors: Dennis B. Hotchkiss, 306 Mesa Ave., Newbury Park, Calif. 91320; Thomas G. Council, 459 Deerhurst Ave., Camarillo, Calif. 93012

[21] Appl. No.: 276,589

[22] Filed: Jul. 18, 1994

[51] Int. Cl.[6] ..... A63B 69/36

[52] U.S. Cl. ..... 273/195 B; 273/34 B

[58] Field of Search ..... 273/195 B, 195 R, 273/197 R, 197 A, 195 A, 201, 204, 207, 34 B, 35 R; 137/625.69

[56] References Cited

U.S. PATENT DOCUMENTS

| | | | |
|---|---|---|---|
| 1,856,259 | 5/1932 | Lyons | 273/207 |
| 2,937,875 | 5/1960 | Mason et al. | 273/195 B |
| 3,633,917 | 1/1972 | Anderson | 273/195 B |
| 4,875,684 | 10/1989 | Benilan | 273/195 B |
| 5,004,243 | 4/1991 | Dlouhy | 273/195 A |
| 5,295,512 | 3/1994 | Adams | 137/625.69 |
| 5,333,876 | 8/1994 | Goto | 273/195 B |
| 5,337,786 | 8/1994 | Rush et al. | 137/625.69 |
| 5,340,111 | 8/1994 | Froelich | 273/195 B |
| 5,358,251 | 10/1994 | Ashton | 273/195 B |

*Primary Examiner*—Vincent Millin
*Assistant Examiner*—Steven B. Wong
*Attorney, Agent, or Firm*—John J. Posta, Jr.

[57] ABSTRACT

An improved golf practice tee apparatus for practicing golf swings is disclosed which provides a golf tee platform that may be selectively adjusted both in angle and in orientation to thereby allow the user of the device to simulate a wide variety of uneven lies. The golf practice tee apparatus has a platform mounted on a platform support frame, which platform support frame is centrally supported above and away from a base frame by a universal member which allows the platform support frame to move with two degrees of freedom of movement with respect to the base frame. Movement of the platform frame with respect to the base frame is controlled by four hydraulic cylinders, movement of which may be selectively, alternatively permitted to allow the angle and the orientation of the platform support frame to be adjusted, or inhibited to freeze the position of the platform support frame with respect to the base frame.

24 Claims, 4 Drawing Sheets

GOLF PRACTICE TEE APPARATUS HAVING SELECTIVELY ADJUSTABLE INCLINATION FOR SIMULATING UNEVEN LIES AND METHOD FOR USE OF SAME

BACKGROUND OF THE INVENTION

Field of the Invention

The present invention relates generally to a practice tee apparatus for golf, and more particularly to an improved practice tee device which provides a platform which may be selectively adjusted both in angle and in orientation to thereby allow the user of the device to simulate a wide variety of uneven lies.

While the game of golf has been played for over five hundred years, recent times have seen a tremendous increase in the number of people around the world who play the game. As a result, while the number of golf courses has increased rapidly to accommodate the increase in the number of golfers, the cost of playing a round of golf has also increased. It has thus become increasingly difficult to learn the game while playing on the golf course, and most people learn the game and practice their swing on a driving range.

Driving ranges feature a number of golf tee areas each having an artificial grass mat mounted on a flat surface in front of a large open area, with golfers hitting a large number of balls from this tee area to practice their golf swing. While driving ranges thus offer golfers a relatively inexpensive way to learn and practice the game of golf, it will at once be appreciated that golf courses have rolling terrain, and thus the flat golf tee areas at driving ranges only allow golfers to practice their swing from a flat lie. It is, of course, desirable to practice the golf swing from uneven lies as well, such as when the ball winds up on a hill, or when the golfer must stand on an area which is not flat in order to hit the ball.

While it is of course possible to construct golf tee areas at driving ranges which are not flat, a fixed non-flat driving range surface will allow the simulation of only a single lie from among countless uneven lies. Thus, driving ranges for the most part have not provided such fixed non-flat driving range surfaces. As might be expected, however, the art is replete with a wide variety of different proposed solutions for this problem, and it is informative to examine several of the different devices suggested in the art.

The various devices taught in the art use a number of different approaches, but initially they may be characterized as either complex devices or simple devices. The simple devices are all manually adjustable, and are shown, for example, by U.S. Pat. No. 4,279,420, to Bay et al., U.S. Pat. No. 4,331,332, to Hughes, and U.S. Pat. No. 5,046,741, to Ahn.

The Bay et al. reference is a platform having adjustable legs located at one end thereof which are used to tilt the platform. The Hughes reference discloses a platform which accepts removable blocks underneath the corners thereof to tilt the platform. The Ahn reference teaches a small tiltable tee platform, which may be used in combination with a wedge-shaped base on which a golfer may stand. All three of these references, while simple and relatively inexpensive, are not acceptable for use in a driving range environment. The Bay et al. and Hughes references present only a single angle of tilt, and are tedious to adjust. The Ahn reference does not simulate a single non-flat surface on which both the golfer and the ball may stand.

The more complex devices fall into three separate categories. The first of these categories is a platform supported by a lockable universal mechanism, and is illustrated by U.S. Pat. No. 3,869,127, to Kohori. The Kohori device is a platform supported by a swivel mechanism which is locked and unlocked by manipulating a handle. The golfer must actuate the handle, which is located close to the ground, by getting off of the platform. The universal swivel mechanism used by Kohori appears to be expensive to construct, and its long term durability in a driving range environment is less than desirable.

The second category of the more complex devices is illustrated by U.S. Pat. No. 3,693,979, to Koett. The Koett device consists of either a single rotating wedge-shaped platform, or two stacked wedge-shaped elements which are independently rotatable. The single wedge embodiment is rotatable to provide a fixed angle surface with a variable orientation. The two wedge embodiment is far more interesting, since it allows the adjustment of both angle and orientation when both of the wedge elements are independently rotatable. The Koett device is electrically operated, and the golfer must step off of the platform to actuate a control to adjust the device. The adjustment can be quite complex, but offers a wide variety of simulated lies, and is suitable for use in a driving range environment.

Finally, the third category of the more complex devices uses powered actuators to move a platform in two degrees of freedom of movement, thereby allowing both angle and orientation to be varied, although not quite independently since both powered actuators must be independently adjusted to adjust the device. This category is illustrated in U.S. Pat. No. 3,633,917, to Anderson, and in U.S. Pat. No. 3,633,918, to Smiley. Smiley uses electrically driven dual jacks to move a platform, while Anderson uses two hydraulic jacks to move a platform. These references share the disadvantage of the Koett device mentioned above, namely that they require two separate adjustments to be made in order to adjust the platform.

It is accordingly the primary objective of the present invention that it provide a golf practice tee apparatus having a mechanism allowing the adjustment of a golf tee platform in a single operation, with the adjustment allowing both the angle and the orientation of the golf tee platform to be set simultaneously. It is a related objective of the present invention that the mechanism facilitating the adjustment operation be simple, requiring only a single control element to bring about the adjustment of the golf tee platform both as to angle and as to orientation. It is another related objective that the control be located on the golf tee platform itself, and that it be operable without requiring the golfer to either get off of the golf tee platform or bend over.

It is an additional objective of the adjustment mechanism of the golf practice tee apparatus of the present invention that it be operable without requiring an external source of power such as electricity or fuel to operate it. It is a related objective that the operation and adjustment of the golf practice tee apparatus of the present invention be accomplished quietly, with essentially no noise which could disturb other golfers in the vicinity. It is a further objective of the golf practice tee apparatus of the present invention that the adjustment operation be entirely safe, and that there be no risk of injury to a golfer operating the adjustment mechanism.

The golf practice tee apparatus of the present invention must also be of construction which is both durable and long lasting, and it should also require little or no maintenance to be provided by the owner throughout its operating lifetime. In order to enhance the market appeal of the golf practice tee apparatus of the present invention, it should also be of relatively inexpensive construction, to thereby afford it the broadest possible market. Finally, it is also an objective that all of the aforesaid advantages and objectives of the golf practice tee apparatus of the present invention be achieved without incurring any substantial relative disadvantage.

SUMMARY OF THE INVENTION

The disadvantages and limitations of the background art discussed above are overcome by the present invention. With this invention, a golf tee platform is supported by a mechanism allowing the golf tee platform to be adjusted both as to angle and as to orientation. The golf practice tee apparatus consists of two main components, which are a base frame and a platform support frame. The platform support frame is centrally supported above and away from the base frame by a universal member, which allows the platform support frame to move with two degrees of freedom of movement. The platform frame is thus free to move to adjust both the angle of the platform frame and the orientation of the platform frame.

Four hydraulic cylinders are used to support the platform support frame from the base frame. The hydraulic cylinders have hydraulic fluid connections located at each end thereof, as is conventional. One pair of the hydraulic cylinders is located to control movement about a first axis (a first degree of freedom of movement), while the other pair of the hydraulic cylinders is located to control movement about a second axis (a second degree of freedom of movement).

A control valve is used to control the flow of hydraulic fluid into and out of the hydraulic cylinders. The valving element is a spool valve which moves longitudinally between first and second positions, and is spring biased to the first position. The fluid connections to all of the hydraulic cylinders are connected to be in fluid communication with the control valve.

When the valving member is in its first position, fluid communication into and out of the control valve is prevented. In this position, all of the hydraulic cylinders will remain in whatever position they are in, since fluid may not flow into or out of any of the four hydraulic cylinders. Thus, when the valving member is in its first position, the platform support frame will be maintained in a fixed position with respect to the base frame.

When the valving member is in its second position, fluid may flow into and out of the control valve through any of the fluid connections to the hydraulic .cylinders. In this second position, the valving member essentially connects all of the fluid channels together, but with a constricted fluid path limiting the rate at which the hydraulic fluid may flow therethrough. This frees the hydraulic cylinders to allow the platform support frame to be moved with respect to the base frame, but at a rate of movement which is controlled to prevent unduly rapid movement.

The control valve is mounted onto the platform support frame, with a control stem facing upwardly. A platform member is mounted on top of the platform support frame, with an aperture in the platform allowing access to the control stem of the control valve. When the handle of a golf club, for example, is placed on top of the control stem and pushed downwardly, the valving member in the control valve is moved from its first position to its second position, thereby allowing the weight of the golfer on the platform to move the platform to the desired angle and orientation.

Two additional apertures are located in the platform on opposite sides of the center of the platform, with a gravity-responsive tee support assembly being located in each of these apertures. The tee support assemblies are each for supporting a standard rubber driving range tee in a vertically upright position, and will move to maintain this position as the platform is adjusted in its position. One of the tee support assemblies is for right handed golfers, and the other is for left handed golfers. The tee support assembly not used will be covered with a tee support cover.

Completing the golf practice tee apparatus of the present invention is an artificial grass mat, which is placed on the platform. In the preferred embodiment, the platform has raised edges to retain the artificial grass mat in place. The golf practice tee apparatus may then be placed in position on a flat surface, and is thus ready for use.

It may therefore be seen that the present invention teaches a golf practice tee apparatus having a mechanism allowing the adjustment of a golf tee platform in a single operation, with the adjustment allowing both the angle and the orientation of the golf tee platform to be set simultaneously. The adjustment mechanism of the golf practice tee apparatus of the present invention is simple both in construction and in operation, and requires only a single control element to bring about the adjustment of the golf tee platform both as to angle and as to orientation. The control for operating the adjustment mechanism of the golf practice tee apparatus of the present invention is located on the golf tee platform itself, and is operable without requiring the golfer to either get off of the golf tee platform or bend over.

The adjustment mechanism of the golf practice tee apparatus of the present invention is operable without requiring an external source of power such as electricity or fuel to operate it. The operation and adjustment of the golf practice tee apparatus of the present invention may be accomplished quietly, with essentially no noise being generated which could disturb other golfers in the vicinity. The adjustment operation of the golf practice tee apparatus of the present invention is also entirely safe, presenting no risk of injury to a golfer operating the adjustment mechanism of the golf practice tee apparatus.

The golf practice tee apparatus of the present invention is of construction which is both durable and long lasting, and will require little or no maintenance to be provided by the owner throughout its operating lifetime. The golf practice tee apparatus of the present invention is of relatively inexpensive construction, thereby enhancing its market appeal and affording it the broadest possible market. Finally, all of the aforesaid advantages and objectives of the golf practice tee apparatus of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the golf practice tee apparatus of the present invention has as its objective the support of a golf tee platform in a manner which allows the golf tee platform to be adjusted as to both angle from a flat or horizontal position, and orientation, or the direction in which the angled golf tee platform faces. This is accomplished by supporting the golf tee platform at its center by a universal swivel mechanism which is supported above a base member. Movement of the golf tee platform is then controlled by a suspension system which is operable to freeze the golf tee platform in any desired position, and which further limits the rate of movement of the golf tee platform to prevent rapid movement with a golfer standing on the golf tee platform.

Figure 1:
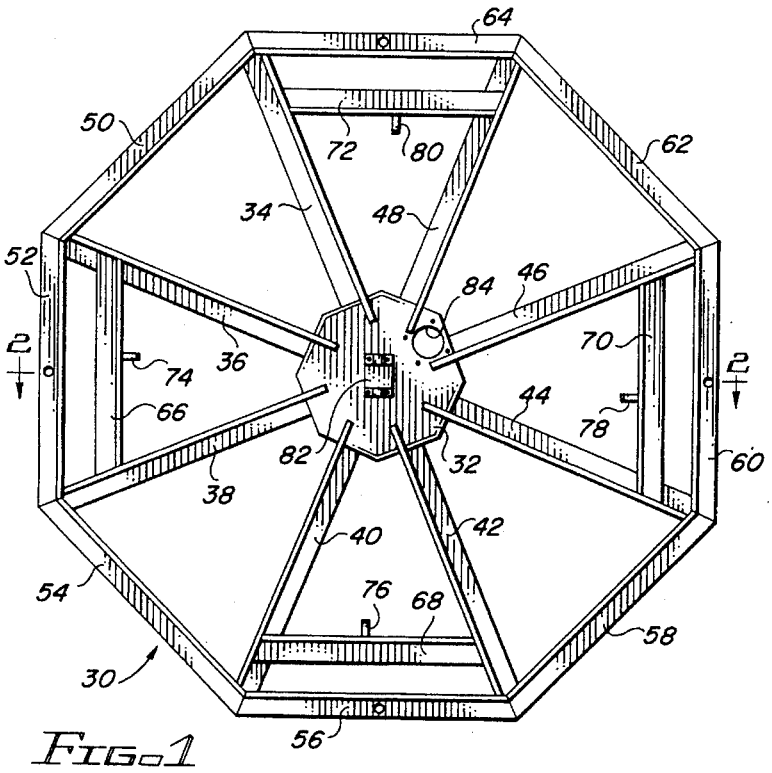
FIG. 1 is a bottom plan view of a platform support frame showing the various members thereof, and particularly showing a universal top support member mounted at the center of the platform support frame.

The first essential component of the golf practice tee apparatus of the present invention is a platform support frame 30 as illustrated in FIG. 1, which is used to support the golf tee platform. The platform support frame 30 consists of a plurality of members which are made of angle iron, and which extend in an array around an octagonally-shaped central platform hub member 32. Specifically, eight platform spokes 34, 36, 38, 40, 42, 44, 46, and 48 are made of angle iron and extend radially outwardly from the platform hub member 32.

Figure 2:
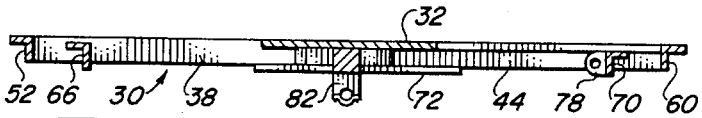
FIG. 2 is a cross-sectional view of the platform support frame illustrated in FIG. 1.

The platform spokes 34, 36, 38, 40, 42, 44, 46, and 48 each extend from the center of one side of the octagonally-shaped platform hub member 32, and are welded in place. Note that one side of the angle iron is cut away from each of the platform spokes 34, 36, 38, 40, 42, 44, 46, and 48 on short portions thereof which extend over the platform hub member 32. This allows the platform hub member 32 and the platform spokes 34, 36, 38, 40, 42, 44, 46, and 48 to jointly present a flat surface, as best seen in FIG. 2.

At the ends of the platform spokes 34, 36, 38, 40, 42, 44, 46, and 48, eight platform rim members 50, 52, 54, 56, 58, 60, 62, and 64 are placed between adjacent ones of the platform spokes 34, 36, 38, 40, 42, 44, 46, and 48 and are welded in place. Specifically, the platform rim member 50 extends between the platform spokes 34 and 36, the platform rim member 52 extends between the platform spokes 36 and 38, the platform rim member 54 extends between the platform spokes 38 and 40, the platform rim member 56 extends between the platform spokes 40 and 42, the platform rim member 58 extends between the platform spokes 42 and 44, the platform rim member 60 extends between the platform spokes 44 and 46, the platform rim member 62 extends between the platform spokes 46 and 48, and the platform rim member 64 extends between the platform spokes 48 and 34.

Four platform cross members 66, 68, 70, and 72 extend between adjacent pairs of the platform rim members 50, 52, 54, 56, 58, 60, 62, and 64 at ninety degree intervals. Specifically, the platform cross member 66 extends between the platform spokes 36 and 38, the platform cross member 68 extends between the platform spokes 40 and 42, the platform cross member 70 extends between the platform spokes 44 and 46, and the platform cross member 72 extends between the platform spokes 48 and 34. The platform cross members 66, 68, 70, and 72 located close to, but are spaced away from, the platform rim members 52, 56, 60, and 64, respectively.

The platform cross members 66, 68, 70, and 72 have platform support tabs 74, 76, 78, and 80, respectively, welded thereon. The platform support tabs 74, 76, 78, and 80 are spaced slightly away from center of the platform cross members 66, 68, 70, and 72, respectively, and thus extend inwardly roughly toward the center of the platform support frame 30. Each of these platform support tabs 74, 76, 78, and 80 has an aperture centrally located therein. It is these platform support tabs 74, 76, 78, and 80 which will be used to control the movement of the platform support frame 30 above a base member (not shown in FIGS. 1 and 2).

Centrally mounted on the bottom side of the platform hub member 32 is a universal top support member 82, which is a part of the universal swivel mechanism which will be used to movably mount the platform support frame 30 above a base member (not shown in FIGS. 1 and 2). Located in the platform hub member 32 is an aperture 84, in which a control valve (not shown in FIGS. 1 and 2) will be mounted. Finally, small apertures are centrally located in the top side of each of the platform rim members 52, 56, 60, and 64. These apertures will be used to mount a platform (not shown in FIGS. 1 and 2) on the platform support frame 30. In the preferred embodiment, the platform support frame 30 is approximately 53 inches across.

Figure 4:
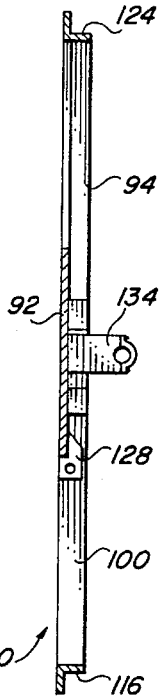
FIG. 4 is a cross-sectional view of the base frame illustrated in FIG. 3.
Figure 3:
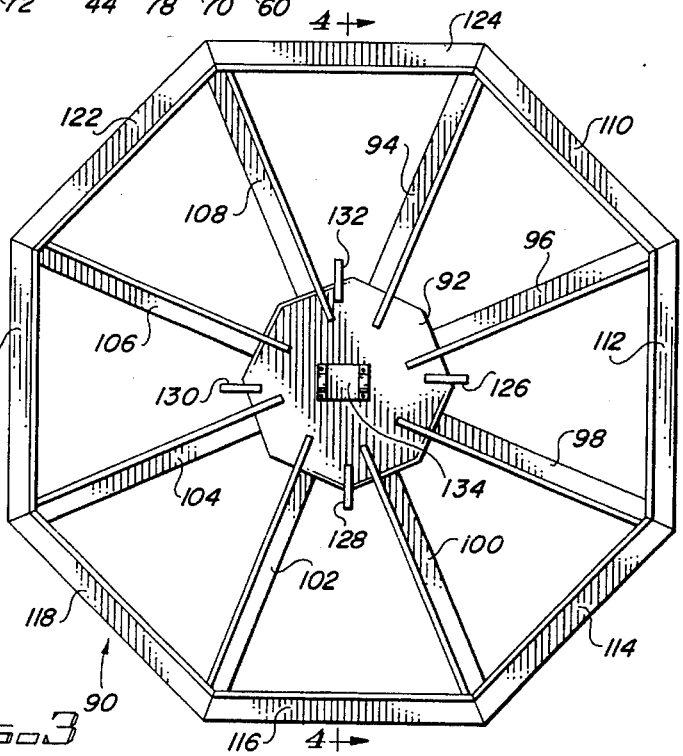
FIG. 3 is a top plan view of a base frame showing the various members thereof, and particularly showing a universal base support member mounted at the center of the base frame.

Referring next to FIGS. 3 and 4, the second essential component of the golf practice tee apparatus of the present invention, a base frame 90, is illustrated. The construction of the base frame 90 is similar to that of the platform support frame 30, and consists of a plurality of members which are made of angle iron, and which extend in an array around a central base hub member 92. Specifically, eight base spokes 94, 96, 98, 100, 102, 104, 106, and 108 are made of angle iron and extend radially outwardly from the base hub member 92.

The base spokes 94, 96, 98, 100, 102, 104, 106, and 108 each extend from the center of one side of the base hub member 92, and are welded in place. Note that one side of the angle iron is cut away from each of the base spokes 94, 96, 98, 100, 102, 104, 106, and 108 on short portions thereof which extend over the base hub member 92. This allows the base hub member 92 and the base spokes 94, 96, 98, 100, 102, 104, 106, and 108 to jointly present a flat surface, as best seen in FIG. 4.

At the ends of the base spokes 94, 96, 98, 100, 102, 104, 106, and 108, eight base rim members 110, 112, 114, 116, 118, 120, 122, and 124 are placed between adjacent ones of the base spokes 94, 96, 98, 100, 102, 104, 106, and 108 and are welded in place. Specifically, the base rim member 110 extends between the base spokes 94 and 96, the base rim member 112 extends between the base spokes 96 and 98, the base rim member 114 extends between the base spokes 98 and 100, the base rim member 116 extends between the base spokes 100 and 102, the base rim member 118 extends between the base spokes 102 and 104, the base rim member 120 extends between the base spokes 104 and 106, the base rim member 122 extends between the base spokes 106 and 108, and the base rim member 124 extends between the base spokes 108 and 94.

The base hub member 92 also has four base support tabs 126, 128, 130, and 132 welded thereon at the outer edges thereof at ninety degree intervals. The base support tab 126 is located between the base spokes 96 and 98, the base support tab 128 is located between the base spokes 100 and 102, the base support tab 130 is located between the base spokes 104 and 106, and the base support tab 132 is located between the base spokes 108 and 94. The base support tabs 126, 128, 130, and 132 are spaced slightly away from radii extending from the center of the base hub member 92, and extend outwardly roughly toward the base rim members 112, 116, 120, and 124, respectively. Each of these base support tabs 126, 128, 130, and 132 has an aperture centrally located therein. It is these base support tabs 126, 128, 130, and 132 from which force will be exerted to control the movement of the platform support frame 30 (FIGS. 1 and 2) above the base frame 90.

Centrally mounted on the top side of the base hub member 92 is a universal bottom support member 134, which is another part of the universal swivel mechanism which will be used to movably mount the platform support frame 30 (FIGS. 1 and 2) above the base frame 90. The universal bottom support member 134 is identical in construction to the universal top support member 82 (FIGS. 1 and 2).

Figure 5:
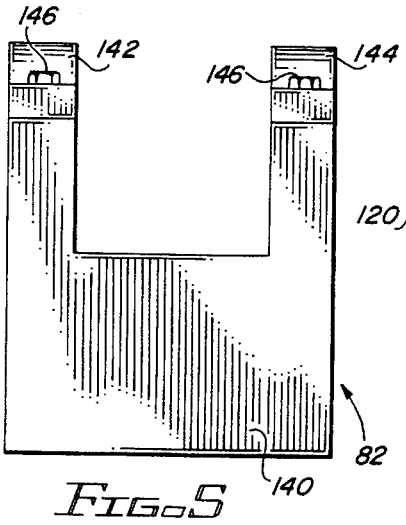
FIG. 5 is a plan view of the universal top support member illustrated on the bottom and at the center of the platform support frame illustrated in FIGS. 1 and 2, showing two retaining members mounted thereon.
Figure 6:
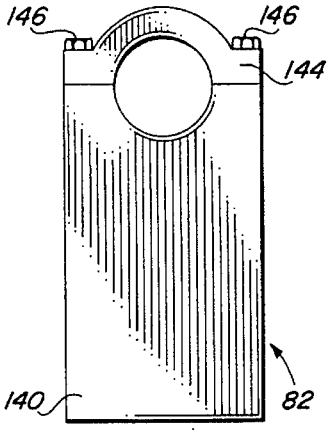
FIG. 6 is a side view of the universal top support member illustrated in FIG. 5.

Referring next to FIGS. 5 and 6, the universal top support member 82 illustrated in FIGS. 1 and 2 is illustrated. The universal top support member 82 consists of three pieces, the largest of which is a U-shaped universal top support base 140. The tops of the arms of the U have a semi-circular recess located therein as best shown in FIG. 6. The circular recesses are both coaxial and identical in size.

The other two parts of the universal top support member 82 are two cap members 142 and 144, which fit on the universal top support base 140 on top of the arms of the U. The cap members 142 and 144 have semi-circular recesses located therein which match the recesses in the tops of the arms of the U of the universal top support base 140. The cap members 142 and 144 are retained on top of the arms of the U of the universal top support base 140 by four bolts 146.

Figure 7:
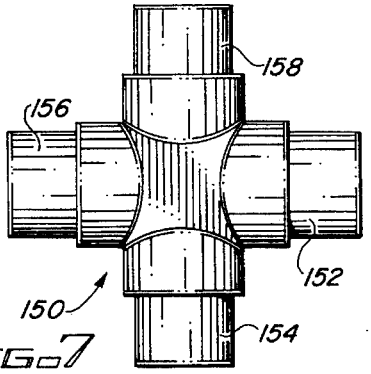
FIG. 7 is a plan view of a universal member used to connect the universal top support member illustrated on the bottom and at the center of the platform support frame illustrated in FIGS. 1 and 2 and the universal base support member illustrated on the top and at the center of the base frame illustrated in FIGS. 3 and 4.

Referring now to FIG. 7, a universal member 150 is illustrated, with four arms extending outwardly at ninety degree intervals in a cross-shaped configuration. The distal ends of the four arms comprise cylindrical segments 152, 154, 156, and 158 of a first identical diameter. The proximal ends of the four arms, which are connected together, comprise cylindrical segments having a second larger diameter. In the preferred embodiment, the base frame 90 is approximately 42 inches across.

Figure 8:
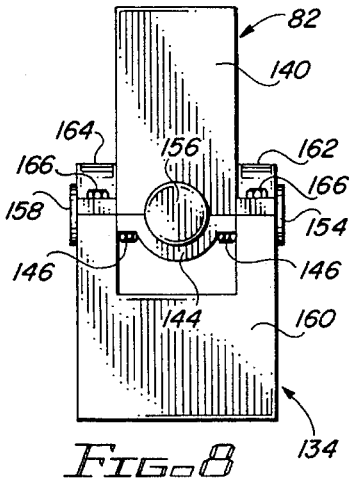
FIG. 8 is a plan view of the universal top support member illustrated on the bottom and at the center of the platform support frame illustrated in FIGS. 1 and 2 connected to the universal base support member illustrated on the top and at the center of the base frame illustrated in FIGS. 3 and 4 with the universal member illustrated in FIG. 7.
Figure 9:
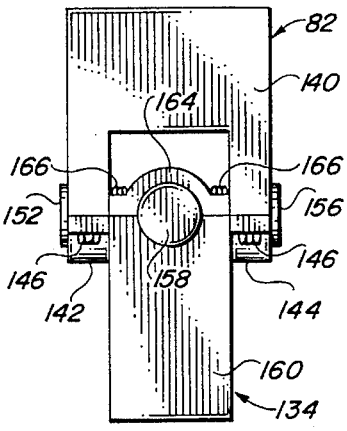
FIG. 9 is a side view of the universal top support member illustrated on the bottom and at the center of the platform support frame illustrated in FIGS. 1 and 2 connected to the universal base support member illustrated on the top and at the center of the base frame illustrated in FIGS. 3 and 4 with the universal member illustrated in FIG. 7.

Referring now to FIGS. 8 and 9, the universal top support member 82 (FIGS. 1 and 2, FIGS. 5 and 6) is shown connected to the universal bottom support member 134 (FIGS. 3 and 4) with the universal member 150 (FIG. 7) to form a universal swivel assembly. Note again that the universal bottom support member 134 is identical in construction to the universal top support member 82, and has a universal bottom support base 160 and two cap members 162 and 164, which are retained by four bolts 166.

Specifically, the cylindrical segment 152 of the universal member 150 is retained between one arm of the universal top support base 140 and the cap member 142, and the cylindrical segment 156 of the universal member 150 is retained between the other arm of the universal top support base 140 and the cap member 144. Likewise, the cylindrical segment 154 of the universal member 150 is retained between one arm of the universal bottom support base 160 and the cap member 162, and the cylindrical segment 158 of the universal member 150 is retained between the other arm of the universal bottom support base 160 and the cap member 164.

It will thus be appreciated by those skilled in the art that the universal swivel assembly illustrated in FIGS. 8 and 9 is used to support the platform support frame 30 (FIGS. 1 and 2) above the base frame 90 (FIGS. 3 and 4). The platform support frame 30 is thus free to be adjusted both in relative angle and in orientation with respect to the base frame 90. In the preferred embodiment, the platform support frame 30 may be tilted up or down to approximately 13 degrees in any direction.

Figure 10:
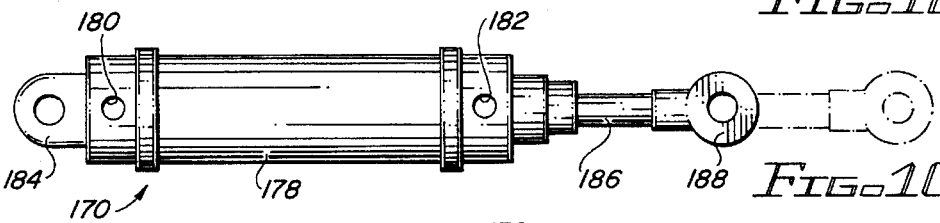
FIG. 10 is a plan view of a hydraulic cylinder having hydraulic fluid connections located at each end thereof, showing the hydraulic cylinder in its retracted position, and also showing the extended position of the hydraulic cylinder in phantom lines.

Referring next to FIG. 10, a hydraulic cylinder 170 is illustrated. The golf practice tee apparatus of the present invention uses three additional hydraulic cylinders 172, 174, and 176 (not shown in FIG. 10), each of which is identical to the hydraulic cylinder 170 illustrated. The hydraulic cylinder 170 has a cylinder body 178 having a hydraulic fluid connection at each end thereof. Located near the end of the cylinder body 178 on the left as illustrated in FIG. 10 is a hydraulic fluid connection 180, and located on the right of the cylinder body 178 is a hydraulic fluid connection 182.

Located at the left of the cylinder body 178 as illustrated in FIG. 10 is a mounting tab 184 having an aperture extending therethrough. Extending from the right side of the hydraulic cylinder 172 as illustrated in FIG. 10 is a shaft 186 which is driven by the hydraulic cylinder 170. Located at the distal end of the shaft 186 is an annular mounting member 188, which has an aperture extending therethrough.

The distal end of the shaft 186 carrying the annular mounting member 188 is moveable between the retracted position illustrated in solid lines in FIG. 10, and the extended position illustrated in phantom lines in FIG. 10. When the shaft 186 moves from the extended position to the retracted position, hydraulic fluid will be forced out of the hydraulic fluid connection 180, and will enter the hydraulic fluid connection 182. Conversely, when the shaft 186 moves from the retracted position to the extended position, hydraulic fluid will be forced out of the hydraulic fluid connection 182, and will enter the hydraulic fluid connection 180. These fluid directions are equally applicable when the hydraulic cylinder 170 is driven by hydraulic fluid under pressure, or when the movement of the shaft 186 forces hydraulic fluid to flow.

Figure 12:
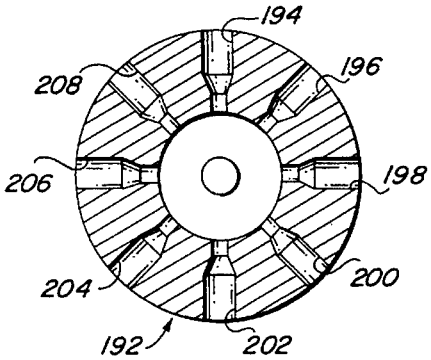
FIG. 12 is a cross-sectional view of the control valve housing of the control valve illustrated in FIG. 11, showing eight fluid connections thereto which are evenly spaced about the periphery of the control valve housing.
Figure 11:
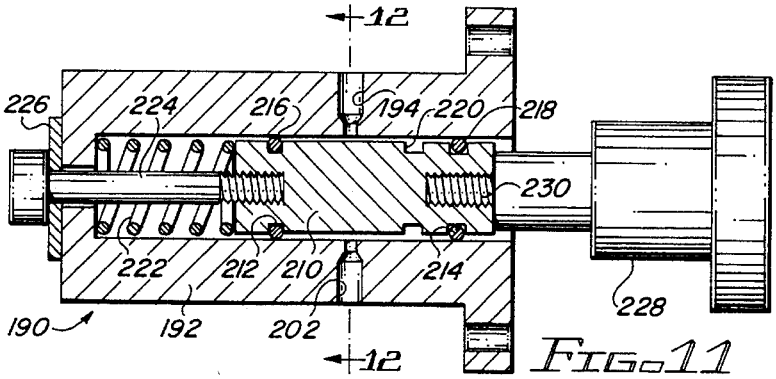
FIG. 11 is a cutaway view of a control valve showing a valving element located therein, the valving element being spring biased to the position shown and having an annular channel located therein, and also showing two fluid connections which will be in communication when the valving element is moved to place the annular channel adjacent to the fluid connections.

Referring now to FIGS. 11 and 12, a control valve 190 for controlling the flow of hydraulic fluid in the golf practice tee apparatus of the present invention is illustrated. The control valve 190 includes a control valve housing 192 which contains a cylindrical bore. The end of the control valve housing 192 illustrated on the right in FIG. 11 is entirely open to the cylindrical bore, while the end of the control valve housing 192 illustrated on the left has a smaller diameter aperture which is coaxial with the cylindrical bore.

Referring particularly to FIG. 12, it may be seen that the control valve housing 192 has eight radially extending fluid connections 194, 196, 198, 200, 202, 204, 206, and 208 located at equally spaced angular positions around the diameter of the control valve housing 192. All eight of the fluid connections 194, 196, 198, 200, 202, 204, 206, and 208 are coplanar.

Referring again to FIG. 11, located inside the cylindrical bore of the control valve housing 192 is a valving element 210 which is essentially cylindrical in configuration. Located around the outer perimeter of the valving element 210 near the end of the valving element 210 illustrated on the left in FIG. 11 is an annular groove 212. Similarly, located around the outer perimeter of the valving element 210 near the end of the valving element 210 illustrated on the right in FIG. 11 is an annular groove 214.

An O-ring 216 is located in the annular groove 212 in the valving element 210. Similarly, an O-ring 218 is located in the annular groove 214 in the valving element 210. The O-rings 216 and 218 act to retain hydraulic fluid therebetween within the control valve 190.

Another annular groove 220 is located around the outer perimeter of the valving element 210 somewhat to the left of the annular groove 214 as illustrated in FIG. 11. It will be appreciated by those skilled in the art that the control valve 190 is a spool valve, with the valving element 210 moving longitudinally within the cylindrical bore in the control valve housing 192.

When the valving element 210 is in the position shown in FIG. 11, hydraulic fluid will not be able to flow into or out of any of the fluid connections 194, 196, 198, 200, 202, 204, 206, and 208 in the control valve housing 192. When the valving element 210 moves to the left as shown in FIG. 11 to a position in which the annular groove 220 is aligned with the fluid connections 194, 196, 198, 200, 202, 204, 206, and 208, hydraulic fluid will be able to flow freely into and out of the fluid connections 194, 196, 198, 200, 202, 204, 206, and 208 through the annular groove 220.

The valving element 210 is biased into the position illustrated in FIG. 11 by a spring 222 contained within the cylindrical bore in the control valve housing 192. The valving element 210 is prevented from moving further to the right from the position illustrated in FIG. 11 by a bolt 224, the end of which extends through a washer 226, through the smaller aperture located at the left of the control valve housing 192, and then into a threaded aperture in the left end of the valving element 210 as illustrated in FIG. 11.

A control stem 228 having a threaded stud 230 extending therefrom is used to operate the control valve 190, with the threaded stud 230 being screwed into a threaded aperture in the right end of the valving element 210 as illustrated in FIG. 11. When the control stem 228 is pressed to the left as illustrated in FIG. 11, the valving element 210 will overcome the biasing force exerted by the spring 222, and will move to the left to place the annular groove 220 into alignment with the fluid connections 194, 196, 198, 200, 202, 204, 206, and 208. When the pressure is removed from the control stem 228, the spring 222 will urge the valving element 210 to the right to prevent fluid communication between the fluid connections 194, 196, 198, 200, 202, 204, 206, and 208.

Completing the construction of the control valve 190 are a plurality of apertures located in the control valve housing 192, which apertures will be used to mount the control valve 190 onto the platform support frame 30 (FIGS. 1 and 2) in the aperture 84 located in the platform hub member 32.

Figure 13:
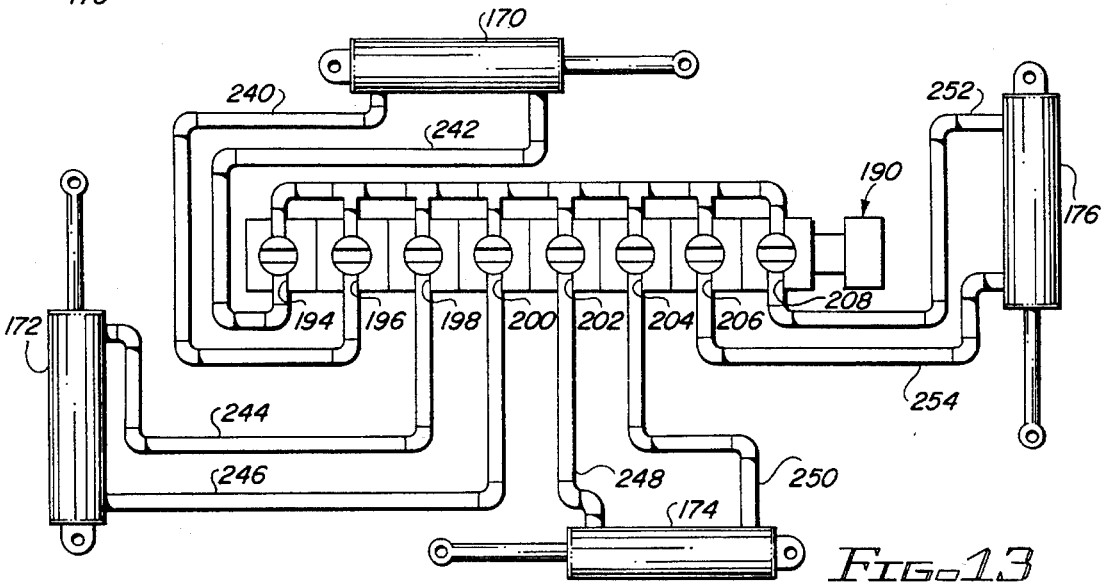
FIG. 13 is a somewhat schematic depiction of the hydraulic fluid connections between the control valve and the four hydraulic cylinders, showing a common channel which is representative of the annular channel illustrated in FIG. 12, and also showing an optional fluid reservoir.

Referring next to FIG. 13, the four hydraulic cylinders 170, 172, 174, and 176 are illustrated, with a somewhat schematic depiction of the control valve 190 and the hydraulic fluid lines connecting the four hydraulic cylinders 170, 172, 174, and 176 to the control valve 190. Thus, the hydraulic fluid lines 240 and 242 connect the hydraulic cylinder 170 to the control valve 190 via the fluid connections 194 and 196, respectively.

Similarly, the hydraulic fluid lines 244 and 246 connect the hydraulic cylinder 172 to the control valve 190 via the fluid connections 198 and 200, respectively. Likewise, the hydraulic fluid lines 248 and 250 connect the hydraulic cylinder 174 to the control valve 190 via the fluid connections 202 and 204, respectively. Finally, the hydraulic fluid lines 252 and 254 connect the hydraulic cylinder 176 to the control valve 190 via the fluid connections 206 and 208, respectively.

It will be appreciated by those skilled in the art that the control valve 190 selectively either connects all of the hydraulic fluid lines 240, 242, 244, 246, 248, 250, 252, and 254 together, or disconnects and isolates them all from each other.

Figure 14:
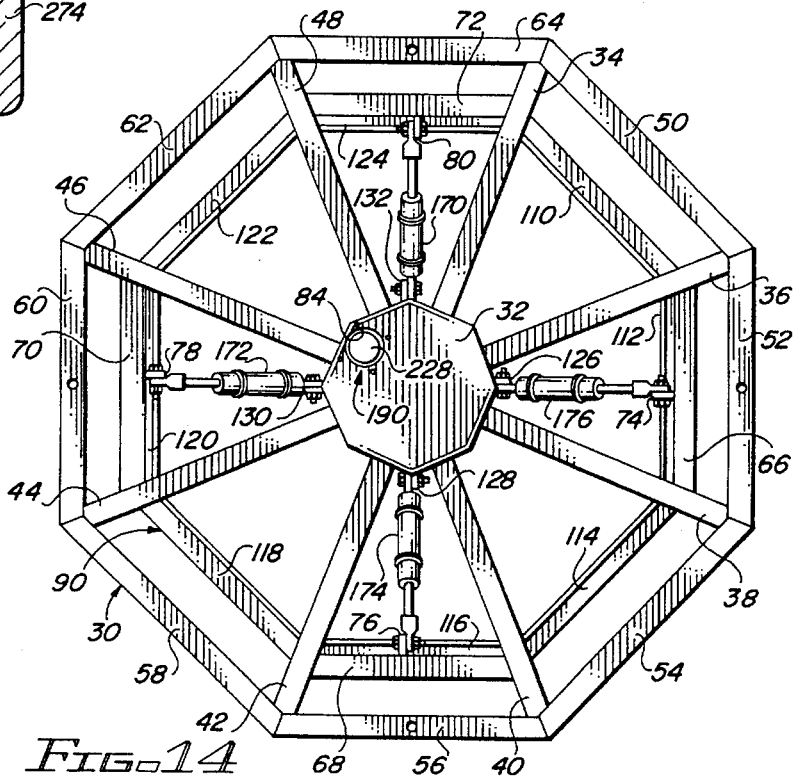
FIG. 14 is a top plan view of the platform support frame illustrated in FIGS. 1 and 2 mounted on the base frame illustrated in FIGS. 3 and 4, with the four hydraulic cylinders illustrated in FIG. 13 connected between the platform support frame and the base frame, and also showing the control valve mounted on the platform support frame near the center thereof.

Referring next to FIG. 14, the platform support frame 30 illustrated in FIGS. 1 and 2 and the base frame 90 illustrated in FIGS. 3 and 4 are illustrated with the hydraulic cylinders 170, 172, 174, and 176 installed. Referring first to the hydraulic cylinder 170 and with reference to FIG. 10 in addition to FIG. 14, it may be seen that the end of the hydraulic cylinder 170 with the shaft 186 is attached to the platform support frame 30, while the end of the hydraulic cylinder 170 with the cylinder body 178 is attached to the base frame 90.

Specifically, the annular mounting member 188 of the hydraulic cylinder 170 is rotatably attached to the platform support tab 80 of the platform support frame 30 using a bolt and a nut. The mounting tab 184 of the hydraulic cylinder 170 is rotatably attached to the base support tab 132 of the base frame 90 using a bolt and a nut.

The other three hydraulic cylinders 172, 174, and 176 are attached in the same manner. Specifically, the hydraulic cylinder 172 is attached between the platform support tab 78 of the platform support frame 30 and the base support tab 130 of the base frame 90 with two bolts and two nuts. Similarly, the hydraulic cylinder 174 is attached between the platform support tab 76 of the platform support frame 30 and the base support tab 128 of the base frame 90 with two bolts and two nuts. Finally, the hydraulic cylinder 176 is attached between the platform support tab 74 of the platform support frame 30 and the base support tab 126 of the base frame 90 with two bolts and two nuts.

The control valve 190 is installed in the aperture 84 in the platform hub member 32 of the platform support frame 30. The hydraulic fluid lines 240, 242, 244, 246, 248, 250, 252, and 254 (FIG. 13) are not illustrated in FIG. 14 for purposes of simplicity. It will be appreciated that when the control stem 228 of the control valve 190 is pressed downwardly, the hydraulic cylinders 170, 172, 174, and 176 will be free to move at a predetermined rate. When the pressure is released from the control stem 228 of the control valve 190, the hydraulic cylinders 170, 172, 174, and 176 will no longer be free to move, and will maintain the platform support frame 30 in whatever position it is then in with respect to the base frame 90.

Figure 15:
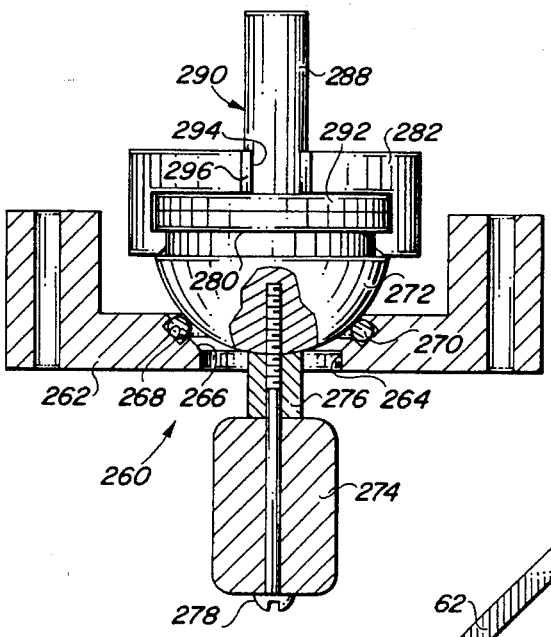
FIG. 15 is a cutaway view of a gravity-responsive tee support assembly having a rubber tee mounted therein, showing a weight mounted under a hemispherical member supported for movement by a Teflon O-ring, with a tee holder mounted on the hemispherical member.
Figure 16:
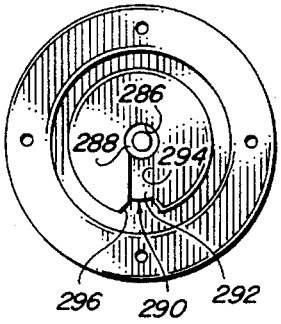
FIG. 16 is a top plan view of the gravity-responsive tee support assembly illustrated in FIG. 15, showing a notch in the tee holder through which the rubber tee may be inserted or removed.

Referring next to FIGS. 15 and 16, a gravity-responsive tee support assembly 260 is illustrated. The tee support assembly 260 has a cup-shaped tee support housing 262, which has an aperture 264 centrally located in the bottom thereof. The top portion of the aperture 264 has a beveled surface 266 therein, which forms a frustroconical segment in the bottom of the tee support housing 262. Recessed into the surface of the beveled surface 266 in the center thereof is a frustroconical groove 268. A Teflon® O-Ring 270 is located in the frustroconical groove 268, and extends outwardly above the surface of the beveled surface 266.

Resting on the Teflon® O-Ring 270 within the tee support housing 262 is a hemispherical ball 272 made of a material having a smooth, non-deformable outer surface. The spherical lower surface of the hemispherical ball 272 is thus free to move in any direction on the Teflon® O-Ring 270. A weight 274 having a vertical aperture extending therethrough and a tubular spacer 276 are suspended below the hemispherical ball 272 using a bolt 278 which extends sequentially through the weight 274, the spacer 276, and is screwed into the bottom of the hemispherical ball 272.

An annular groove 280 is cut into the surface of the hemispherical ball 272. The annular groove 280 is spaced away from the flat top surface of the hemispherical ball 272. An inverted cup-shaped tee holder 282 has an inwardly extending lip 284 located in the inside of the bottom thereof. The lower inside edge of the inwardly extending lip 284 is beveled to facilitate mounting the tee holder 282 onto the hemispherical ball 272.

Referring specifically to FIG. 16, a circular aperture 286 is located in the center of the closed top side of the tee holder 282. The circular aperture 286 is sized to be just larger than the diameter of the cylindrical portion 288 of a standard rubber driving range tee 290. The diameter of the interior of the tee holder 282 is sized to be just larger than a base 292 of the standard rubber driving range tee 290. Note that the diameter of the flat top portion of the hemispherical ball 272 is just slightly larger than the diameter of the base 292 of the standard rubber driving range tee 290.

The tee holder 282 has a notch 294 cut into the side thereof, which notch 294 is just narrower than the diameter of the cylindrical portion 288 of the standard rubber driving range tee 290. The notch 294 leads to the circular aperture 286 in the tee holder 282, and has a tapered outer portion 296 which facilitates insertion of the cylindrical portion 288 of the standard rubber driving range tee 290 into the notch 294 of the tee holder 282. The tee holder 282 is snapped down over the flat top side of the hemispherical ball 272, with the inwardly extending lip 284 of the tee holder 282 fitting into the annular groove 280 of the hemispherical ball 272.

It will thus be appreciated by those skilled in the art that the standard rubber driving range tee 290 is inserted into the tee holder 282 by sliding the base 292 of the standard rubber driving range tee 290 under the top side of the tee holder 282, with the cylindrical portion 288 of the standard rubber driving range tee 290 fitting through the notch 294 into the circular aperture 286 in the tee holder 282. When the tee support housing 262 is tilted, the weight 274 will cause the spherical lower surface of the hemispherical ball 272 to slide on the Teflon® O-Ring 270, with the force of gravity bringing the cylindrical portion 288 of the standard rubber driving range tee 290 into a vertical position. The construction of the tee support assembly 260 is completed by a plurality of apertures extending through the tee support housing 262 about the outer periphery thereof to facilitate mounting the tee support assembly 260 on a golf tee platform (not shown in FIGS. 15 or 16).

Figure 17:
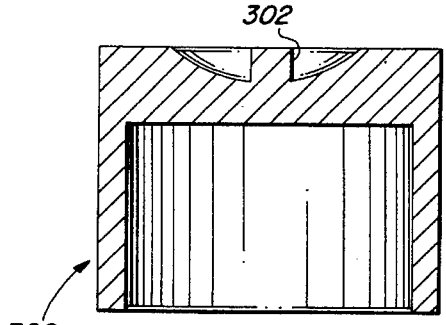
FIG. 17 is a cross-sectional view of a tee support cover for use in covering the gravity-responsive tee support assembly illustrated in FIGS. 15 and 16, showing a grip handle located in the top thereof.

Turning next to FIG. 17, an inverted cup-shaped tee support cover 300 is illustrated. The tee support cover 300 has inner and outer diameters such that the tee support cover 300 will fit over the tee holder 282 and the hemispherical ball 272 of the tee support assembly 260 (FIG. 15) to cover them. The height of the tee support cover 300 is such that when the tee support cover 300 is so installed onto the tee support assembly 260, the top of the tee support cover 300 will be flush with the surface of a golf tee platform (not illustrated in FIG. 17). The top surface of the tee support cover 300 has a handle 302 recessed therein, which handle 302 may be used to place the tee support cover 300 onto the tee support assembly 260, and to remove the tee support cover 300 from the tee support assembly 260.

Figure 19:
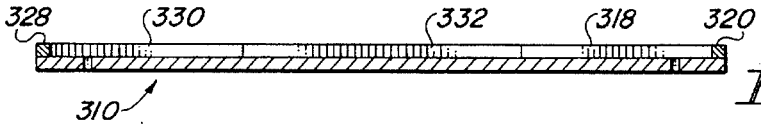
FIG. 19 is a cross-sectional view of the platform illustrated in FIG. 18, showing the raised edges of the platform.
Figure 18:
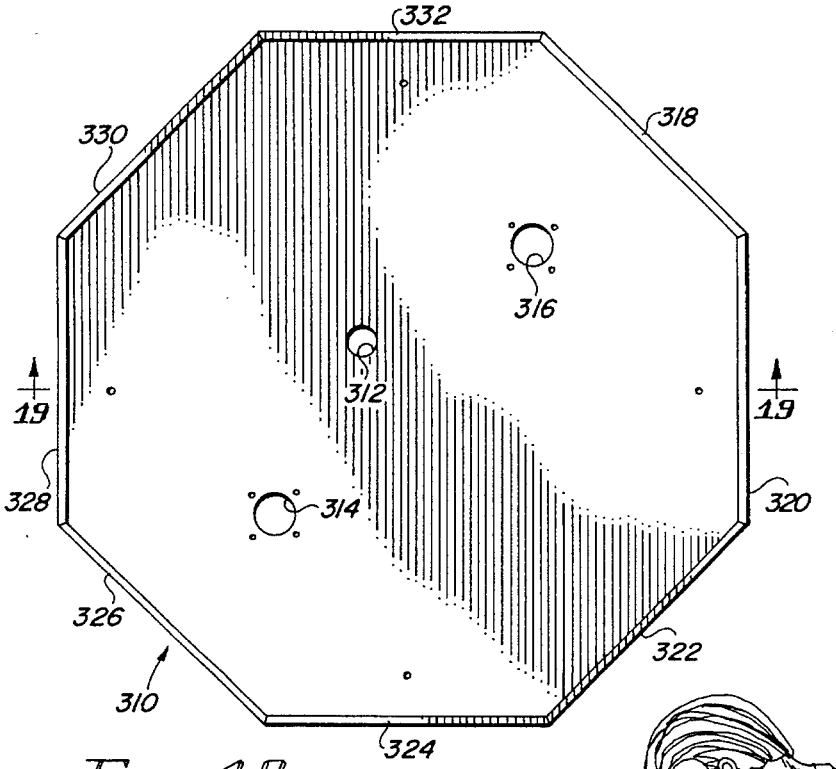
FIG. 18 is a top plan view of a platform for mounting on top of the platform support frame illustrated in FIG. 14, the platform having raised edges, showing an aperture through which the control valve may be accessed, and also showing two apertures in which two of the gravity-responsive tee support assemblies illustrated in FIGS. 15 and 16 will be mounted.

Referring now to FIGS. 18 and 19, a platform 310 for installation onto the top of the platform support frame 30 (FIG. 14) is illustrated. The platform 310 is in the preferred embodiment made of one inch thick plywood, and may be octagonal as illustrated in FIG. 18. In the preferred embodiment, the platform 310 is approximately 60 inches in diameter.

The platform 310 has an aperture 312 located just off-center through which the control stem 228 of the control valve 190 (FIG. 14) will extend, with the control stem 228 being approximately flush with the surface of the platform 310 when the platform 310 is installed onto the platform support frame 30. The platform 310 also has a pair of apertures 314 and 316 located opposite each other, which apertures 314 and 316 will each have a tee support assembly 260 mounted therein.

Also shown are four small apertures located near sides of the platform 310 which are spaced ninety degrees apart. These small apertures will be used to mount the platform 310 onto the platform support frame 30 (FIG. 14). Located above the surface of the platform 310 adjacent the edges thereof are eight thin wooden strips 318, 320, 322, 324, 326, 328, 330, and 332. The height of each of the thin wooden strips 318, 320, 322, 324, 326, 328, 330, and 332 is equal to the thickness of an artificial grass mat (not shown in FIGS. 18 and 19).

Figure 20:
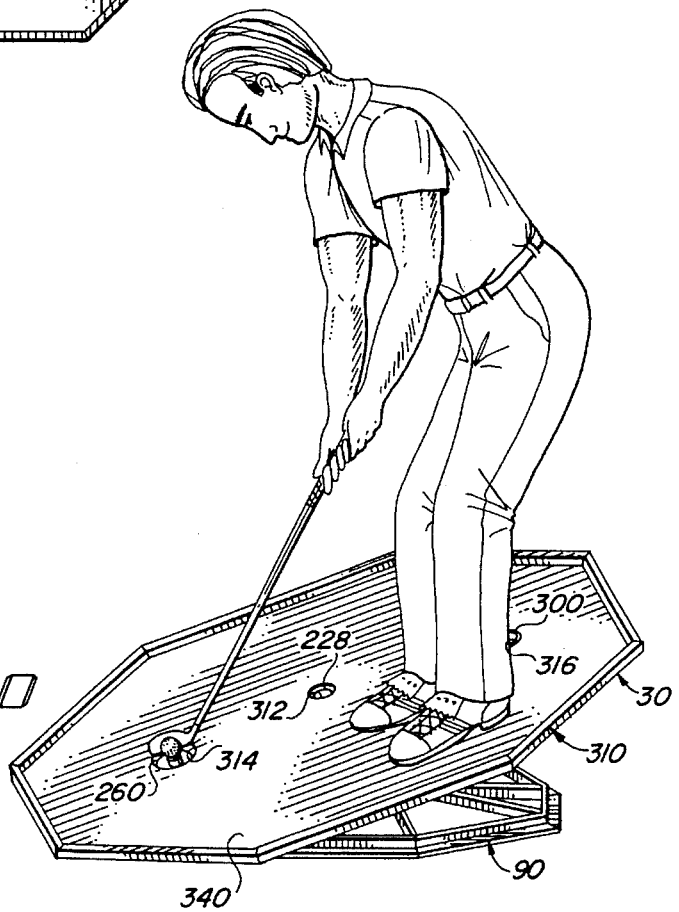
FIG. 20 is a perspective view of the assembly illustrated in FIG. 14 with the platform illustrated in FIGS. 18 and 19 mounted on the platform support frame, and with an artificial grass mat mounted on the platform, showing one of the gravity-responsive tee support assemblies illustrated in FIGS. 15 and 16 holding a rubber tee with a golf ball mounted thereon, and with the tee support cover mounted over the other gravity-responsive tee support assembly, and also showing a golfer standing on the golf practice tee apparatus with the golf tee platform adjusted to an desired angle and orientation.

Referring finally to FIG. 20, the platform 310 (FIGS. 18 and 19) is shown mounted on the platform support frame 30 (FIG. 14). An artificial grass mat 340 is shown mounted on top of the platform 310. Note that the artificial grass mat 340 has apertures located therein which correspond to the apertures 312, 314, and 316 in the platform 310 (FIG. 18). Note that a tee support assembly 260 is mounted in the aperture 314 in the platform 310. A second tee support assembly 260 is mounted in the aperture 316 in the platform 310, but the second tee support assembly 260 is covered by the tee support cover 300.

To use the golf tee platform device illustrated in FIG. 20, the end of the shaft of a golf club is placed on the control stem 228 of the control valve 190, and depressed. This allows the four hydraulic cylinders 170, 172, 174, and 176 (FIG. 14) to move, thereby allowing the platform support frame 30 to move at a predetermined controlled rate with respect to the base frame 90. By varying where the golfer places his or her feet, the platform support frame 30 may be angled and oriented as desired. When the desired position is reached, the shaft of the golf club is removed from the control stem 228 of the control valve 190, locking the platform support frame 30 in that position with respect to the base frame 90.

It may therefore be appreciated from the above detailed description of the preferred embodiment of the present invention that it teaches a golf practice tee apparatus having a mechanism allowing the adjustment of a golf tee platform in a single operation, with the adjustment allowing both the angle and the orientation of the golf tee platform to be set simultaneously. The adjustment mechanism of the golf practice tee apparatus of the present invention is simple both in construction and in operation, and requires only a single control element to bring about the adjustment of the golf tee platform both as to angle and as to orientation. The control for operating the adjustment mechanism of the golf practice tee apparatus of the present invention is located on the golf tee platform itself, and is operable without requiring the golfer to either get off of the golf tee platform or bend over.

The adjustment mechanism of the golf practice tee apparatus of the present invention is operable without requiring an external source of power such as electricity or fuel to operate it. The operation and adjustment of the golf practice tee apparatus of the present invention may be accomplished quietly, with essentially no noise being generated which could disturb other golfers in the vicinity. The adjustment operation of the golf practice tee apparatus of the present invention is also entirely safe, presenting no risk of injury to a golfer operating the adjustment mechanism of the golf practice tee apparatus.

The golf practice tee apparatus of the present invention is of construction which is both durable and long lasting, and will require little or no maintenance to be provided by the owner throughout its operating lifetime. The golf practice tee apparatus of the present invention is of relatively inexpensive construction, thereby enhancing its market appeal and affording it the broadest possible market. Finally, all of the aforesaid advantages and objectives of the golf practice tee apparatus of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A mechanical golf practice tee apparatus, comprising:

a base member;

a platform member adapted for a golfer to stand on while practicing a golf swing;

a swivel member for supporting said platform member above said base member, said swivel member allowing said platform member to be adjusted both in the amount of angle of said platform member with respect to said base member and in the relative orientation of said angle of said platform member with respect to said base member;

a plurality of hydraulic cylinders for positioning said platform member with respect to said base member, each of said hydraulic cylinders having a pair of hydraulic fluid connections thereto, each of said hydraulic cylinders being continuously moveable between a retracted position and an extended position when hydraulic fluid is allowed to flow freely into and out of said pair of hydraulic fluid connections, each of said hydraulic cylinders being fixed in position and immovable when hydraulic fluid is not allowed to flow freely into and out of said pair of hydraulic fluid connections;

a substantially fixed volume of hydraulic fluid;

fluid conduit means directly interconnecting all of said hydraulic cylinders; and a control valve for alternately, selectively allowing or preventing said hydraulic fluid from flowing directly between said hydraulic cylinders and into and out of each of said pairs of hydraulic fluid connections.

2. A golf practice tee apparatus as defined in claim 1, wherein said swivel member comprises:

a universal bottom support member mounted on top of said base member at the center thereof;

a universal top support member mounted under said platform member at the center thereof; and a universal member for placement intermediate said universal bottom support member and said universal top support member.

3. A golf practice tee apparatus as defined in claim 1, wherein each of said plurality of hydraulic cylinders comprises:

a cylinder body having a first end and a second end, one of said hydraulic fluid connections being located near said first end of said cylinder body and the other of said hydraulic fluid connections being located near said second end of said cylinder body;

a mounting tab located at said first end of said cylinder body, said mounting tab for attachment to one of said base member and said platform member;

a shaft extending from said second end of said cylinder body, only a shorter portion of said shaft extending from said cylinder body when said hydraulic cylinder is in said retracted position, a longer portion of said shaft extending from said cylinder body when said hydraulic cylinder is in said extended position; and a mounting member located on the end of said shaft opposite said cylinder body, said mounting member being for attachment to the other of said base member and said platform member.

4. A golf practice tee apparatus as defined in claim 1, wherein said plurality of hydraulic cylinders comprises:

four hydraulic cylinders each having a first end and a second end.

5. A golf practice tee apparatus as defined in claim 4, wherein said platform member has four sides which are approximately ninety degrees apart, and wherein said first end of each of said four hydraulic cylinders is operatively connected to said platform member relatively near a different one of said four sides of said platform member, and wherein said second end of each of said four hydraulic cylinders is operatively connected to said base member.

6. A golf practice tee apparatus as defined in claim 5, wherein said second end of each of said four hydraulic cylinders is located on said base member relatively near the center thereof.

7. A golf practice tee apparatus as defined in claim 1, wherein said control valve comprises:

a control valve housing having a plurality of fluid connections thereto; and a valving element located within said control valve housing, said valving element having a first position in which all of said fluid connections in said control valve housing are isolated and out of fluid communication with each other, and a second position in which all of said fluid connections in said control valve housing are placed in fluid communication with each other.

8. A golf practice tee apparatus as defined in claim 7, wherein said control valve additionally comprises:

a biasing spring for driving said valving element from said second position to said first position.

9. A golf practice tee apparatus as defined in claim 7, wherein said control valve housing and said valving element are adapted to limit the rate of hydraulic fluid flow when said valving element is in said second position to control the rate at which said hydraulic cylinders can move between said retracted position and said extended position.

10. A golf practice tee apparatus as defined in claim 7, wherein said control valve housing is mounted in said platform member, and wherein said control valve additionally comprises:

a control stem for driving said valving element from said first position to said second position when said control stem is depressed, said control stem being mounted flush with the surface of said platform member when said control stem is not depressed.

11. A golf practice tee apparatus as defined in claim 7, wherein said control valve is a spool valve, wherein said control valve housing has a cylindrical aperture located therein, and wherein said valving element is essentially cylindrical.

12. A golf practice tee apparatus as defined in claim 1, wherein said platform member comprises:

a platform support frame;

a platform mounted on said platform support frame; and a first tee support assembly for supporting a standard rubber driving range tee therein, said first tee support assembly being mounted in said platform.

13. A golf practice tee apparatus as defined in claim 12, additionally comprising:

an artificial grass mat mounted on top of said platform.

14. A golf practice tee apparatus as defined in claim 12, additionally comprising:

an second tee support assembly for supporting a standard rubber driving range tee therein, said second tee support assembly being mounted in said platform, wherein said first tee support assembly is located in a position on said platform for use by golfers who are right-handed, and wherein said second tee support assembly is located in a position on said platform for use by golfers who are left-handed.

15. A golf practice tee apparatus as defined in claim 12, wherein said first tee support assembly comprises:

a tee holder for removably holding a standard rubber driving range tee therein; and apparatus for supporting said tee holder in an orientation whereby a standard rubber driving range tee held therein will be supported in a vertical orientation regardless of the relative position of said platform member relative to said base member.

16. A golf practice tee apparatus, comprising:

a base member;

a platform member adapted for a golfer to stand on while practicing a golf swing;

a swivel member for supporting said platform member above said base member, said swivel member allowing said platform member to be adjusted both in the amount of angle of said platform member with respect to said base member and in the relative orientation of said angle of said platform member with respect to said base member;

a plurality of hydraulic cylinders for supporting said platform member above said base member, each of said hydraulic cylinders having a pair of hydraulic fluid connections thereto, each of said hydraulic cylinders being continuously moveable between a retracted position and an extended position when hydraulic fluid is allowed to flow freely into and out of said pair of hydraulic fluid connections, each of said hydraulic cylinders being fixed in position and immovable when hydraulic fluid is not allowed to flow freely into and out of said pair of hydraulic fluid connections;

a control valve for alternately, selectively allowing or preventing hydraulic fluid from flowing into and out of each of said pairs of hydraulic fluid connections;

wherein said platform member comprises a platform support frame;

a platform mounted on said platform support frame;

a first tee support assembly for supporting a standard rubber driving range tee therein, said first tee support assembly being mounted in said platform;

a second tee support assembly for supporting a standard rubber driving range tee therein, said second tee support assembly being mounted in said platform, wherein said first tee support assembly is located in a position on said platform for use by golfers who are right-handed, and wherein said second tee support assembly is located in a position on said platform for use by golfers who are left-handed; and a tee support cover for covering the one of said first and second tee support assemblies which is not to be used, said tee support cover fitting flush with the surface of said platform when said tee support cover is so installed.

17. A golf practice tee apparatus, comprising:

a base member;

a platform member adapted for a golfer to stand on while practicing a golf swing;

a swivel member for supporting said platform member above said base member, said swivel member allowing said platform member to be adjusted both in the amount of angle of said platform member with respect to said base member and in the relative orientation of said angle of said platform member with respect to said base member;

a plurality of hydraulic cylinders for supporting said platform member above said base member, each of said hydraulic cylinders having a pair of hydraulic fluid connections thereto, each of said hydraulic cylinders .being continuously moveable between a retracted position and an extended position when hydraulic fluid is allowed to flow freely into and out of said pair of hydraulic fluid connections, each of said hydraulic cylinders being fixed in position and immovable when hydraulic fluid is not allowed to flow freely into and out of said pair of hydraulic fluid connections;

a control valve for alternately, selectively allowing or preventing hydraulic fluid from flowing into and out of each of said pairs of hydraulic fluid connections;

wherein said platform member comprises a platform support frame;

a platform support frame;

a platform mounted on said platform support frame;

a first tee support assembly for supporting a standard rubber driving range tee therein, said first tee support assembly being mounted in said platform;

wherein said first tee support assembly comprises a tee holder for removably holding a standard rubber driving range tee therein;

apparatus for supporting said tee holder in an orientation whereby a standard rubber driving range tee held therein will be supported in a vertical orientation regardless of the relative position of said platform member relative to said base member; and a hemispherical member having a flat upper surface on which said tee holder is mounted:

a tee support housing having an aperture therein, said aperture in said tee support housing having an upwardly oriented beveled frustroconical surface thereabout;

a O-ring made of low-friction material mounted partially within said beveled frustroconical surface, said hemispherical member fitting into said beveled frustroconical surface; and a weight mounted below said tee support housing and attached to said hemispherical member with an arm extending through said aperture in said tee support housing, said weight tending to be gravitationally drawn downwardly to cause said hemispherical member in said beveled frustroconical surface to maintain a standard rubber driving range tee held in said tee holder in a vertical orientation regardless of the relative position of said platform member relative to said base member.

18. A mechanical golf practice tee apparatus, comprising:

a base member;

a platform member adapted for a golfer to stand on while practicing a golf swing;

a tee support assembly for supporting a standard rubber driving range tee therein, said tee support assembly being mounted in said platform member;

a swivel member for supporting said platform member above said base member, said swivel member allowing said platform member to be adjusted both in the amount of angle of said platform member with respect to said base member and in the relative orientation of said angle of said platform member with respect to said base member;

four hydraulic cylinders for positioning said platform member at opposite sides thereof with respect to said base member, each of said hydraulic cylinders having a pair of hydraulic fluid connections thereto, each of said hydraulic cylinders being continuously moveable between a retracted position and an extended position when hydraulic fluid is allowed to flow freely into and out of said pair of hydraulic fluid connections, each of said hydraulic cylinders being fixed in position and immovable when hydraulic fluid is not allowed to flow freely into and out of said pair of hydraulic fluid connections;

a substantially fixed volume of hydraulic fluid;

fluid conduit means directly interconnecting all of said hydraulic cylinders; and a control valve for alternately, selectively allowing or preventing said hydraulic fluid from flowing directly between said hydraulic cylinders and into and out of each of said pairs of hydraulic fluid connections, said control valve being mounted in said platform and being accessible from the top side of said platform.

19. A mechanical golf practice tee apparatus, comprising:

a base member;

a platform member adapted for a golfer to stand on while practicing a golf swing, a swivel member for supporting said platform member above said base member, said swivel member allowing said platform member to be adjusted both in the amount of angle of said platform member with respect to said base member and in the relative orientation of said angle of said platform member with respect to said base member;

a plurality of hydraulic cylinders for supporting said platform member above said base member, each of said hydraulic cylinders being continuously moveable between a retracted position and an extended position when a first operational condition is present in the operation of each of said hydraulic cylinders, each of said hydraulic cylinders being fixed in position and immovable when said first operational condition is not present in the operation of each of said hydraulic cylinders; fluid conduit means directly interconnecting said hydraulic cylinders; and a control mechanism which permits the movement of hydraulic fluid directly between hydraulic cylinders thereby alternately causing, or not causing, said first operational condition to be present.

20. A method of making a mechanical golf practice tee apparatus, comprising:

supporting a platform member above a base member with a swivel member, said platform member being adapted for a golfer to stand on while practicing a golf swing, said swivel member allowing said platform member to be adjusted both in the amount of angle of said platform member with respect to said base member and in the relative orientation of said angle of said platform member with respect to said base member;

supporting said platform member above said base member with a plurality of hydraulic cylinders, each of said hydraulic cylinders having a pair of hydraulic fluid connections thereto, each of said hydraulic cylinders being continuously moveable between a retracted position and an extended position when hydraulic fluid is allowed to flow freely directly between hydraulic cylinders and into and out of said pair of hydraulic fluid connections, each of said hydraulic cylinders being fixed in position and immovable when hydraulic fluid is not allowed to flow freely into and out of said pair of hydraulic fluid connections; and with a control valve, alternately, selectively allowing or preventing hydraulic fluid from flowing directly between hydraulic Cylinders and into and out of each of said pairs of hydraulic fluid connections.

21. A mechanical golf practice tee apparatus for providing a variable tee surface, comprising:

a substantially flat platform;

position varying means to vary the position of said platform to other than a level position;

said position varying means including a plurality of directly interconnected hydraulic cylinders having a common reservoir of hydraulic fluid; and means to control the exchange of hydraulic fluid directly between said hydraulic cylinders.

22. The apparatus of claim 21 including wherein said means to control the exchange of fluid between said hydraulic cylinders include a fluid control switch located on said platform.

23. The apparatus of claim 21 including a tee support mechanism disposed in said platform wherein a standard driving range tee held therein will be maintained in an upright position regardless of the orientation of the platform.

24. The apparatus of claim 22 wherein said fluid control switch is a spool valve.

* * * * *